US011230029B2

(12) United States Patent
Wang

(10) Patent No.: US 11,230,029 B2
(45) **Date of Patent: *Jan. 25, 2022**

(54) MULTI-PURPOSE UTILITY CLAMP

(71) Applicant: Henry Wang, Winter Springs, FL (US)

(72) Inventor: Henry Wang, Winter Springs, FL (US)

( * ) Notice: Subject to any disclaimer, the term of this patent is extended or adjusted under 35 U.S.C. 154(b) by 323 days.

This patent is subject to a terminal disclaimer.

(21) Appl. No.: 16/110,747

(22) Filed: Aug. 23, 2018

(65) Prior Publication Data

US 2018/0361612 A1 Dec. 20, 2018

Related U.S. Application Data

(63) Continuation of application No. 14/728,154, filed on Jun. 2, 2015, now Pat. No. 10,099,398.
(Continued)

(51) Int. Cl.
*B27B 27/10* (2006.01)
*B25B 5/00* (2006.01)
(Continued)

(52) U.S. Cl.
CPC ..... *B27B 27/10* (2013.01); *B25B 5/003* (2013.01); *B25B 5/006* (2013.01); *B25B 5/102* (2013.01); *B25B 5/163* (2013.01)

(58) Field of Classification Search
CPC ..... B25B 27/10; B25B 5/003; B25B 5/006; B25B 5/102; B25B 5/163
See application file for complete search history.

(56) References Cited

U.S. PATENT DOCUMENTS 1,026,475 A 5/1912 Tarbuck
1,793,560 A 2/1931 Schmieder
(Continued)

FOREIGN PATENT DOCUMENTS

DE 9200535 U1 12/1993
GB 2276114 A 9/1994
(Continued)

OTHER PUBLICATIONS

"The Rockier T-Track Table Top", www.newwoodworker.com/reviews/rcklrttrktbletoprvu.html; Aug. 26, 2013.
(Continued)

*Primary Examiner* — Lee D Wilson
*Assistant Examiner* — Jonathan G Santiago Martinez
(74) *Attorney, Agent, or Firm* — Wolter Van Dyke Davis, PLLC; Robert L. Wolter

(57) ABSTRACT

Embodiments of a multi-purpose utility clamp may include a component engagement member having a clamp head and a handle. A guide arm is operatively connected to the component engagement member at a first end of the guide arm. A first post is operatively connected to a second end of the guide arm to move linearly relative to the guide arm. A second post at an end of the support post is disposed generally perpendicular to the first post and has a first end connected to the first post and a second end, distal the first end, and the second end is disposed opposite the clamping head. The second post has a generally trapezoidal cross-sectional shape along a length thereof between the first end and the second end, and the second post is configured to be inserted into a channel having a corresponding trapezoidal shape and formed in an auxiliary component to be clamped to another component.

8 Claims, 14 Drawing Sheets

Related U.S. Application Data

(60) Provisional application No. 62/007,017, filed on Jun. 3, 2014.

(51) Int. Cl.
*B25B 5/10* (2006.01)
*B25B 5/16* (2006.01)

(56) References Cited

U.S. PATENT DOCUMENTS

| | | | |
|---|---|---|---|
| 2,366,350 | A | 1/1945 | Ostling |
| 2,642,905 | A | 6/1953 | Hewat |
| 3,052,462 | A | 9/1962 | Butler |
| 3,575,405 | A | 4/1971 | Harding |
| 3,664,654 | A | 5/1972 | Manville |
| 3,697,046 | A | 10/1972 | Sur |
| D248,728 | S | 8/1978 | Elliott |
| 4,753,425 | A | 6/1988 | Yang |
| 4,805,888 | A | 2/1989 | Bishop |
| 4,861,011 | A | 8/1989 | Varga |
| 4,867,427 | A | 9/1989 | Cunningham |
| 4,962,918 | A | 10/1990 | Yang |
| 5,009,134 | A | 4/1991 | Sorensen et al. |
| 5,015,421 | A | 5/1991 | Messner |
| 5,018,562 | A | 5/1991 | Adams |
| 5,135,209 | A | 8/1992 | Penny |
| 5,181,702 | A | 1/1993 | Pettigrew |
| 5,190,271 | A | 3/1993 | Otterbein, II |
| 5,305,992 | A | 4/1994 | Kish |
| 5,405,124 | A | 4/1995 | Mayer et al. |
| 5,730,434 | A | 3/1998 | Schoene et al. |
| 5,768,966 | A | 6/1998 | Duginske |
| 6,123,326 | A | 9/2000 | Kleinbongartz |
| 6,244,582 | B1 | 6/2001 | Marcolina |
| 6,451,070 | B1 | 9/2002 | Kent et al. |
| 6,453,643 | B1 | 9/2002 | Buscherini et al. |
| 6,505,391 | B1 | 1/2003 | Schneider |
| 6,568,667 | B1 | 5/2003 | Hall |
| 6,860,475 | B2 | 3/2005 | Wong |
| 6,889,968 | B1 | 5/2005 | Wong |
| 6,935,628 | B1 | 8/2005 | Conversa |
| 7,000,519 | B1 | 2/2006 | Weinstein et al. |
| 7,040,609 | B1 | 5/2006 | Liou |
| 7,114,714 | B2 | 10/2006 | Wong |
| 7,415,912 | B2 | 8/2008 | Tyler |
| 8,020,840 | B2 | 9/2011 | Hall, Jr. |
| 8,220,374 | B2 | 7/2012 | Wang |
| 8,632,240 | B2 | 1/2014 | Tang et al. |
| 9,151,422 | B2 | 10/2015 | Kayacik et al. |
| 9,216,485 | B2 | 12/2015 | Huang |
| 10,099,398 | B2 * | 10/2018 | Wang ..... B25B 5/006 |
| 2004/0245692 | A1 | 12/2004 | Brass et al. |
| 2007/0132165 | A1 | 6/2007 | Hughes |
| 2008/0127794 | A1 | 6/2008 | Jaksha |

FOREIGN PATENT DOCUMENTS

| | | | |
|---|---|---|---|
| GB | 2339402 | A | 1/2000 |
| WO | 1997043094 | A1 | 11/1997 |

OTHER PUBLICATIONS

Common Woodworking joints—RaygirlingWWJoints—Ray Girling—2005.

* cited by examiner

MULTI-PURPOSE UTILITY CLAMP

CROSS-REFERENCE TO RELATED APPLICATIONS

This application claims the benefit of U.S. Provisional Application No. 62/007,017 filed Jun. 3, 2014, and is a continuation of application Ser. No. 14/728,154, entitled "MULTI-PURPOSE UTILITY CLAMP" and filed on Jun. 2, 2015, both of which are incorporated herein by reference in their entirety.

BACKGROUND OF THE INVENTION

This invention relates generally to the field of clamping devices used to temporarily secure together two components. More specifically, the invention pertains to clamps that are used to provide additional work surfaces to woodworking apparatuses such as cutting apparatuses or woodworking benches.

With respect to woodworking apparatuses such as cutting devices (i.e., table saws, routers and band saws), clamps may be used to secure an auxiliary fence to an existing machine fence to provide additional surface area to support work pieces for cutting or to provide a sacrificial fence. Similarly, clamps may be used to affix wood boards to benches to increase working area space. Such auxiliary fences or boards are typically configured so the clamps engage these components and the woodworking apparatus in a manner to provide a flush and/or clear working surface.

Prior art auxiliary fences often include extruded metal (aluminum) members; however, these components are limited in size because of manufacturing cost and weight. In addition, the channels for receiving clamps extend in only one direction. That is, the extruded metal fences cannot be manufactured to include channels in multiple directions. Accordingly, woodworking enthusiasts and professionals often use wood boards as auxiliary or sacrificial fences that are adapted to receive clamps so that a flush work surface is available. More specifically, channels may be formed along edges of the board to receive a clamp post; however, the boards have a height dimension similar to that of the fence for the cutting tool and do not function well with larger wooden work pieces to be cut.

Alternatively, T-shaped grooves or channels have been formed on one side of the board to receive a T-shaped clamping post of a clamp, but the cross-sectional dimensions of these channels are not standardized, and the end users have difficulties in cutting the properly sized grooves to receive T-shaped clamping posts of a clamp. In addition, the T-shaped channels if cut too deep may compromise the structural integrity of the work surface. If cut too shallow, the T-shaped channels form thin strips of wood on the clamp side, which strips can readily break thereby comprising the attachment of the auxiliary fence to the machine fence of the woodworking apparatus.

Embodiments of a multi-purpose utility clamp may include a component engagement member having a clamp head and a handle. A guide arm is operatively connected to the component engagement member at a first end of the guide arm. A first post is operatively connected to a second end of the guide arm to move linearly relative to the guide arm. A second post at an end of the support post is disposed generally perpendicular to the first post and has a first end connected to the first post and a second end, distal the first end, and the second end is disposed opposite the clamping head. The second post has a generally trapezoidal cross-sectional shape along a length thereof between the first end and the second end, and the second post is configured to be inserted into a channel having a corresponding trapezoidal shape and formed in an auxiliary component to be clamped to another component.

In an embodiment, the second post has a front surface facing the clamp head and a back surface opposite and generally parallel to the front surface, wherein the back surface is wider than the front surface. First and second opposite side surfaces extending from the back surface to the front surface are disposed at an angle of about 76° relative to the back surface, or at an angle of about 14° relative to a reference line that is perpendicular to the back surface.

Embodiments of the invention may also include a multi-purpose utility clamp in combination with an auxiliary wooden component configured to be clamped to a woodworking apparatus. The clamp may comprise a component engagement member including a clamp head and a handle. A guide arm is operatively connected to the component engagement member at a first end of the guide arm. A first post is operatively connected to a second end of the guide arm to move linearly relative to the guide arm; and, a second post at an end of the first post is disposed generally perpendicular to the first post and has a first end connected to the first post and a second end, distal the first end, and the second end is disposed opposite the clamping head. The second post has a generally trapezoidal cross-sectional shape along a length thereof between the first end and the second end, and the second post is configured to be inserted into a channel having a corresponding trapezoidal shape and formed in an auxiliary component to be clamped to another component. The wooden auxiliary component includes at least one channel formed in the wooden component, and the at least one channel has a cross-section trapezoidal corresponding to the trapezoidal shape of the second post.

BRIEF DESCRIPTION OF THE DRAWINGS

These and other advantages of the invention will become more apparent from the following description in view of the drawings. Similar structures illustrated in more than one figure are numbered consistently among the drawings.

DETAILED DESCRIPTION OF THE INVENTION

In describing particular features of different embodiments of the present invention, number references will be utilized in relation to the figures accompanying the specification. Similar or identical number references in different figures may be utilized to indicate similar or identical components among different embodiments of the present invention.

It is to be noted that the terms "first," "second," and the like as used herein do not denote any order, quantity, or importance, but rather are used to distinguish one element from another. The terms "a" and "an" do not denote a limitation of quantity, but rather denote the presence of at least one of the referenced item. Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. As a non-limiting example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 7. It is to be noted that all ranges disclosed within this specification are inclusive and are independently combinable.

Figure 1:
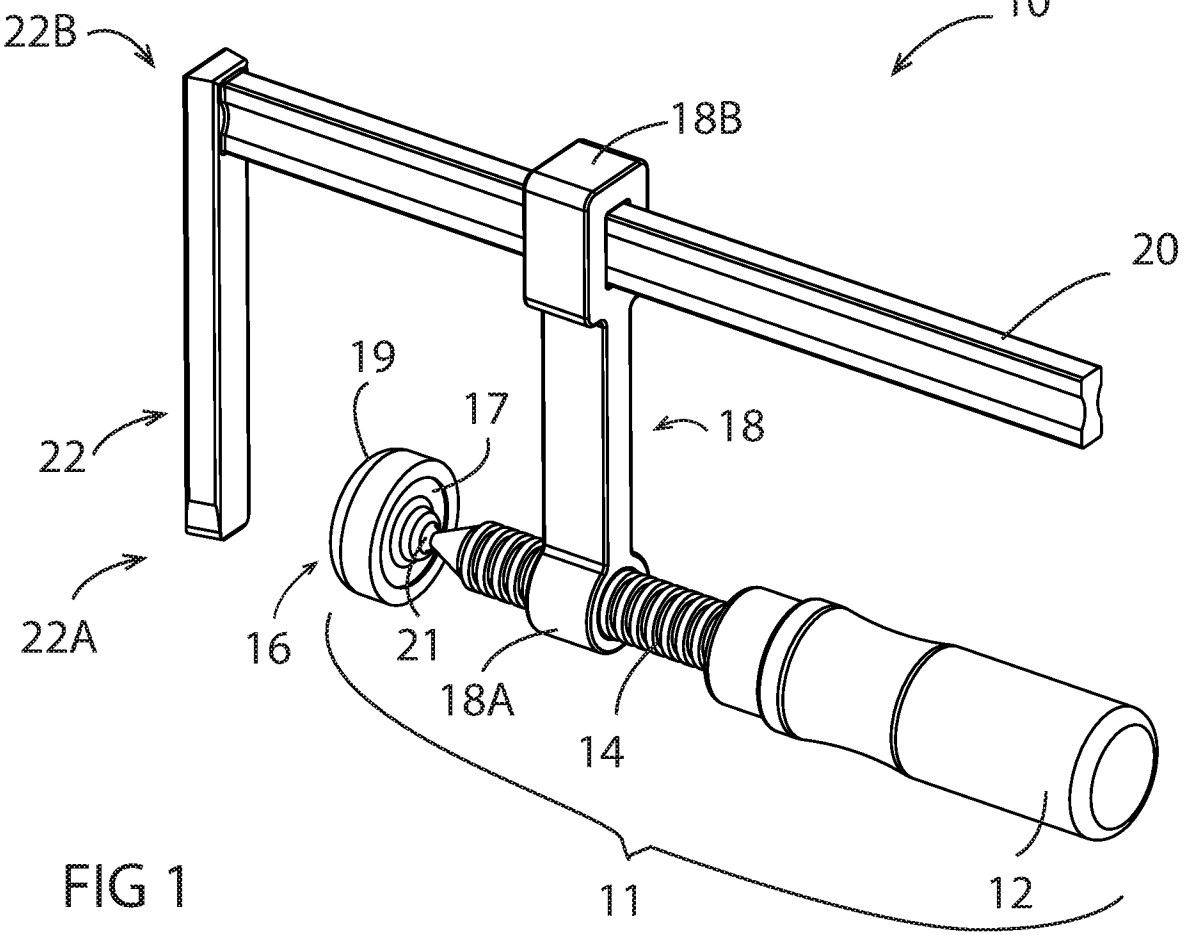
FIG. 1 is a perspective view of a clamp in accordance with the present invention.

In reference to FIG. 1 a clamp 10 is illustrated and includes a component engagement member 11 that may further include a handle 12 affixed to one end of a threaded shaft 14 and a clamp head 16 pivotally attached to the other end of the other threaded shaft 14. In an embodiment, the clamp head 16 may include disc 17 fabricated from a metal alloy such as stainless steel and a cap member 19 fitted over the disc member 17. The cap member 19 may be fabricated from a natural or synthetic rubber, or a plastic material. Embodiments may include the head clamp 16 pivotally interconnected to the shaft 14. By way of example, a ball and socket type joint 21 may be provided so the clamp head 16 pivots relative to the shaft 14.

A guide arm 18 is provided in threaded engagement with the threaded shaft 14 at a first end 18A thereof and supports a first post 20 at a second end 18B. The first post 20 is connected in linear sliding engagement with the guide arm 18 to accommodate different thicknesses of items to be claimed together. A second post 22 (also referred to herein as "clamping post") is attached to the first post 20 at preferably, substantially 90° and extends toward the clamp head 16. The term "substantially" or "generally" perpendicular means within ±5° of 90°, and preferably within ±2° of 90°. The first post 20 and second post 22 may be separate parts that are welded together, or other fastening mechanisms may be used to secure the posts, 20, 22 together. Alternatively, the first and second posts 20, 22 or may be forged or made as a single integral component.

As will be explained in more detail below, when clamping to components together, the second post 22 is inserted into a channel of an auxiliary (or second) component to be clamped to a woodworking apparatus. The second or auxiliary component, which may be a wooden member with one or more channels, is positioned against a surface, such as a fence of a table or table saw or router table (or a first component), and the clamp head 16 is positioned against the first component by sliding the first post 20 along the guide arm 18 away from the first component, or sliding the engagement member 11, including the clamp head 16 toward the first and second components. The handle 12 is then rotated thereby rotating the threaded shaft 14 so the clamp head 16 moves linearly toward the second post 22 securing the two components together.

The threaded shaft 14 acts as a gear mechanism operatively connected to the guide arm 18 to facilitate relative movement of the clamp head 16, guide arm 18 and clamping post 22 to clamp to components together. While embodiments described herein includes the guide arm 18 attached in threaded engagement with the threaded shaft 14 for adjustment of the second post 22 relative to the clamp head 16, the invention is not so limited, and may include other gear mechanisms or other clamping mechanisms. For example, the guide arm 18 may be operatively connected to a handle that has lock and ratcheting mechanism to position the second post 22 relative to the clamp head 16 such as incorporated in the Quick Clamp sold by Festool. In addition, the term handle is intended to cover any type of gripping member that allows manipulation of the clamp 10, such as a knob. To that end, the invention is not limited to a rotatable handle connected to a threaded shaft. In addition, the invention is not limited to the embodiment shown and described herein wherein the support post 20 is in sliding engagement with the guide arm 18. The invention is intended to cover any clamp, with the below-described clamping post member with a cross-sectional trapezoidal shaped post member corresponding to a dovetail shape of a channel formed in an auxiliary fence, bench or work piece.

The inventor of the subject invention has innovatively developed the clamp 10 including a clamping post (second post 22) that has a generally trapezoidal or dovetail cross-sectional configuration. In an embodiment, the trapezoidal configuration extends the length of the clamping post 22, or is disposed at least at or toward a first end 22A of the clamping post 22, or the trapezoidal configuration is disposed along a length of the second post 22 between the first end 22A and second end 22B thereof, and the trapezoidal shape does not have to necessarily extend an entire length of the second post 22. In addition, the second post 22 may be slightly narrower at the tip of the first end 22A so the second post 22 can be readily inserted into a channel on the second component. One or more dovetail channels or channels are preferably formed in the auxiliary component having the dimensions of a dovetail router bit that is commonly and widely used by woodworking enthusiasts and professionals. In this manner, end users can readily form dovetail channels in which the clamping post 22 snugly fits for clamping. Moreover, although the invention is described in reference to use with woodworking apparatuses, the invention is not so limited. The inventive clamp may be used with a variety of different fabricating tools and could be used with, for example, metal fabricating tools. In addition, the second auxiliary component may be wooden or composed of other materials such as metallic materials.

Figure 2:
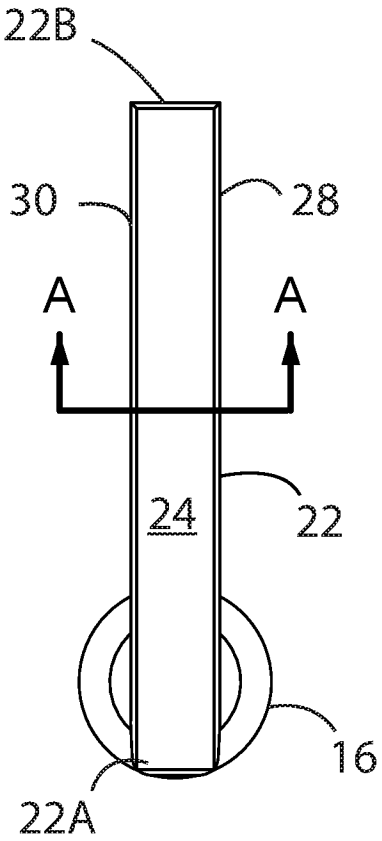
FIG. 2 is an end view of the clamp of FIG. 1.
Figure 2A:
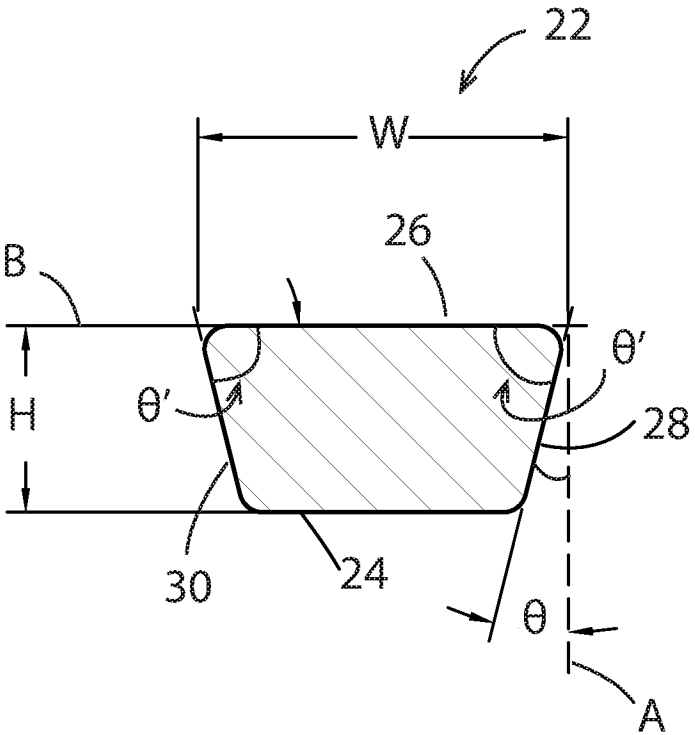
FIG. 2A is a cross-sectional view taken along line A-A of FIG. 2, illustrating the cross-sectional dovetail shape of a clamping post of the clamp.
Figures 3, 3A:
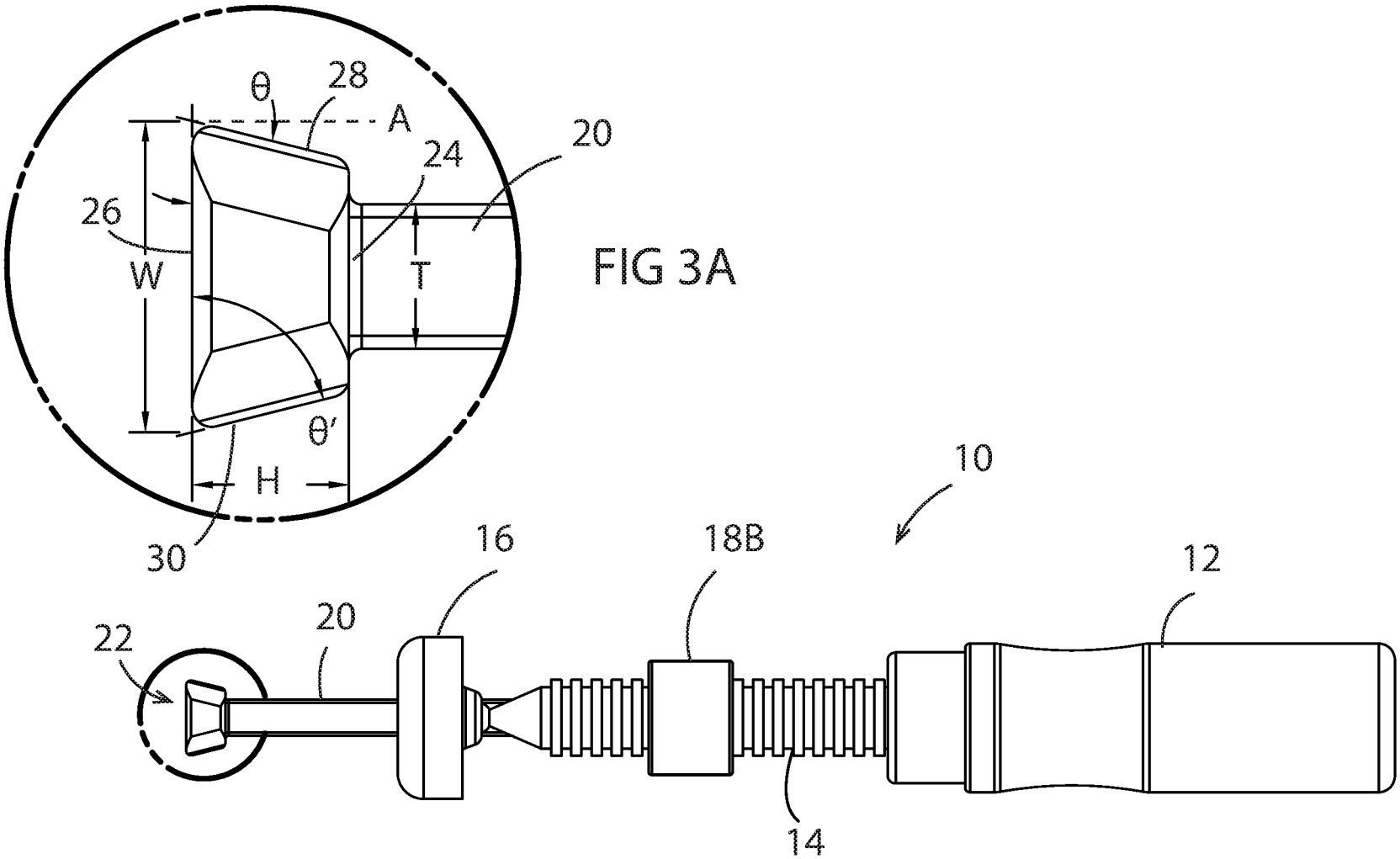
FIG. 3 is a bottom view of the fence clamp of FIG. 1.
FIG. 3A is an exploded view of the end of the clamping post of FIG. 3.

In reference to FIGS. 2 and 2A, the second post or clamping post 22 is illustrated in more detail. More specifically, as shown in FIG. 2A the post 22 has a trapezoidal or dovetail cross-sectional shape including tapered side surfaces 28, 30 extending between end surfaces 24, 26. The end surfaces 24, 26 include a front surface 24 that faces the clamp head 16 and a back surface 26. The back surface 26 is wider than the front surface 24 so the side surfaces 28, 30 taper inward toward the front surface 24. These tapered surfaces 28, 30 may extend from a first end 22A to a second end 22B of the clamping post 22. In a preferred embodiment, the side surfaces 28, 30 are tapered at an angle θ from about 13.5° to about 14.5° and preferably about 14° as measured from dashed reference line A of FIG. 2A, which is perpendicular to the back surface 26; or, the side surfaces 28, 30 are tapered at an angle θ' from about 75.5° to about 76.5°, and preferably about 76° as measured from back surface 26 to either side surface 28 or 30 as shown FIG. 2A. As shown in FIGS. 3 and 3A, the first end 22A of the clamping post 22 A that initially is inserted in a dovetail channel is similarly dimensioned. That is, the side surfaces are tapered at an angle of about 14° from the surface 26, which engages a component for clamping, to the opposite parallel surface 24.

Again with respect to FIGS. 2A and 3A, the clamping post 22 may have a width dimension "W" of about 0.5 inches and preferably about 0.481 inches, and a height dimension "H" of about 0.240 inches, and preferably about 0.243 inches; however, embodiments of the invention are not limited to these width "W" and height "H" dimensions. Nor is the invention limited to the above-described angles. These dimensions and angles may vary according to the corresponding dimensions of a channel, within which the clamping post 22 is inserted for fixing an auxiliary work piece to a woodworking apparatus.

Figure 4:
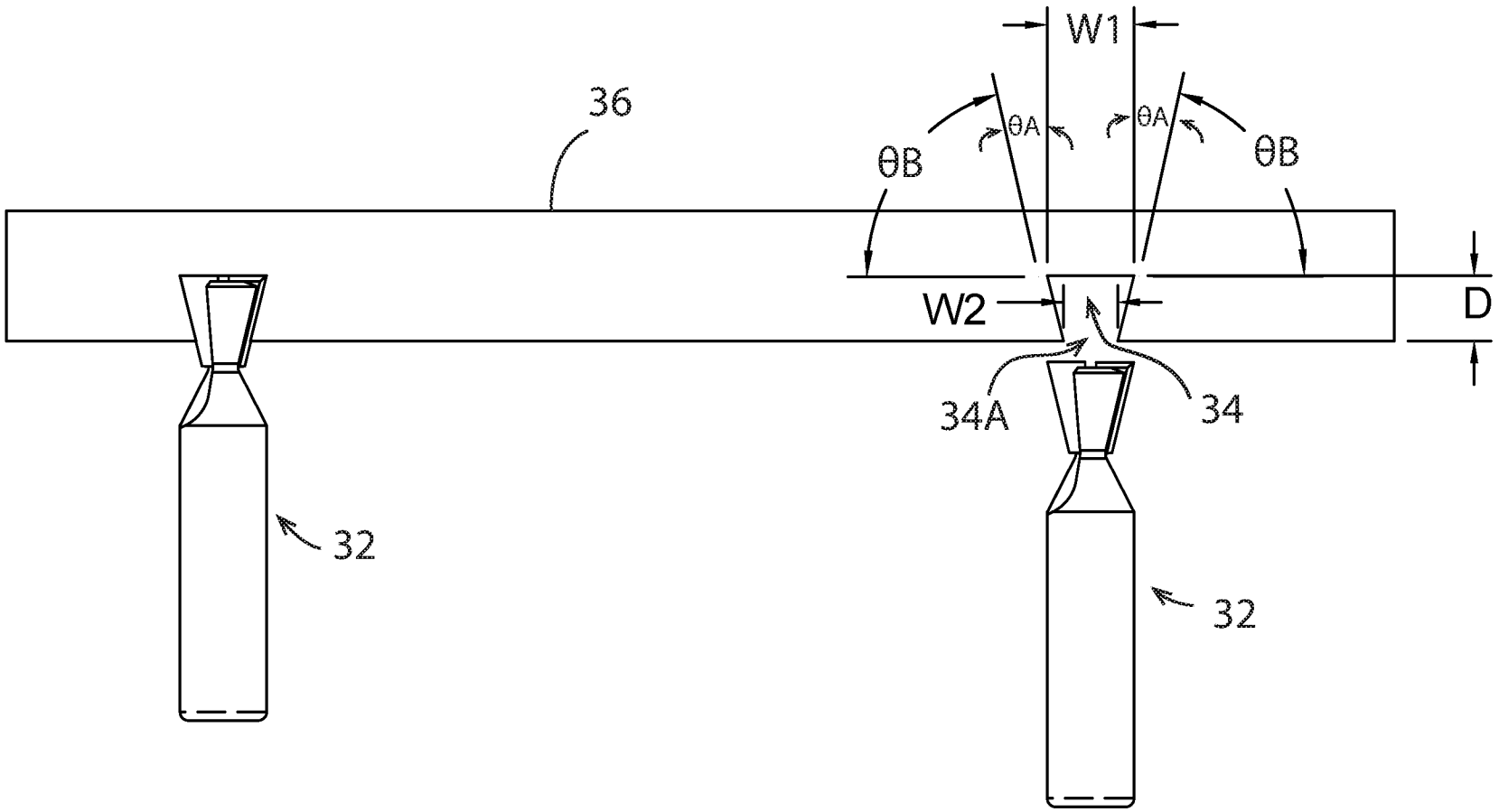
FIG. 4 is an elevational view of an accessory with a dovetail shaped channel cut for receiving the clamping post of the clamp.

With respect to FIG. 4 router bits 32 are shown in connection with a work piece 36 and a channel 34 formed therein corresponding to the router bit 32. The router bit 32 shown in FIG. 4 is preferably a widely used bit with, for example, a ½" outside diameter and 14° taper. In reference to FIGS. 2A and 4, the dimensions of the post clamp 22 are slightly smaller than that of the channel 34 formed in the auxiliary wood part 36, so the clamping post 22 snugly fits therein for clamping. By way of example, a channel 34 using the above described ½" router bit may have a width "W1" that is about 0.500 inches at its widest that tapers to a width "W2" at an opening 34A of the channel 34. In addition, the channel 34 may have a depth dimension "D" of about 0.375 inches. In a preferred embodiment, the height dimension "H" of FIG. 2A, is less than the depth dimension "D" of FIG. 4. The angles θA are about 14°, and angles θB are about 76°. In this manner, when the clamp 10 is fixed to an auxiliary component and the woodworking apparatus, the side surfaces 28, 30 engage the inclined surfaces of the channel 34.

Figure 5:
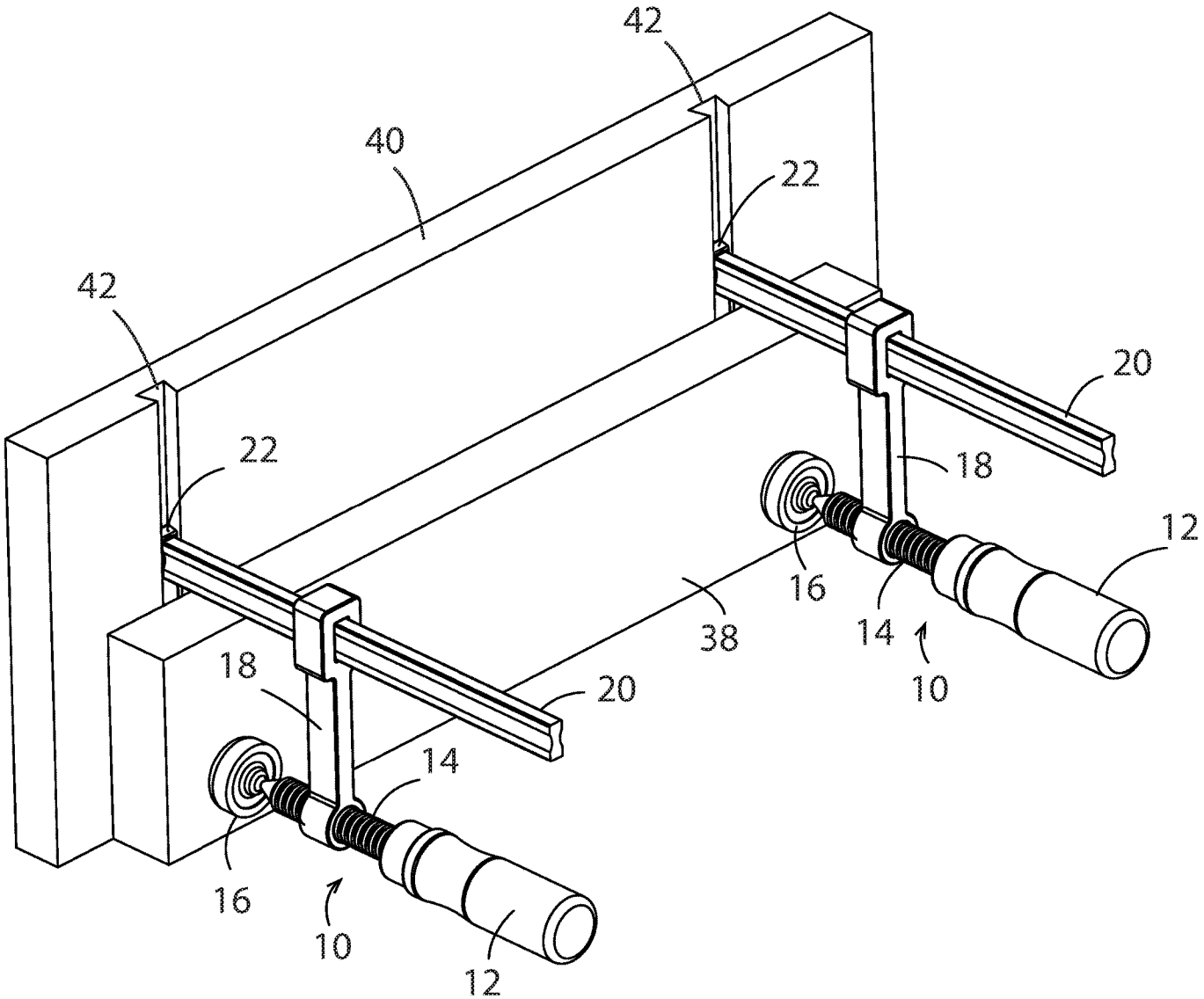
FIG. 5 is a perspective view of auxiliary fence affixed to a machine fence of a woodworking cutting device using an embodiment of the inventive clamp.
Figure 7:
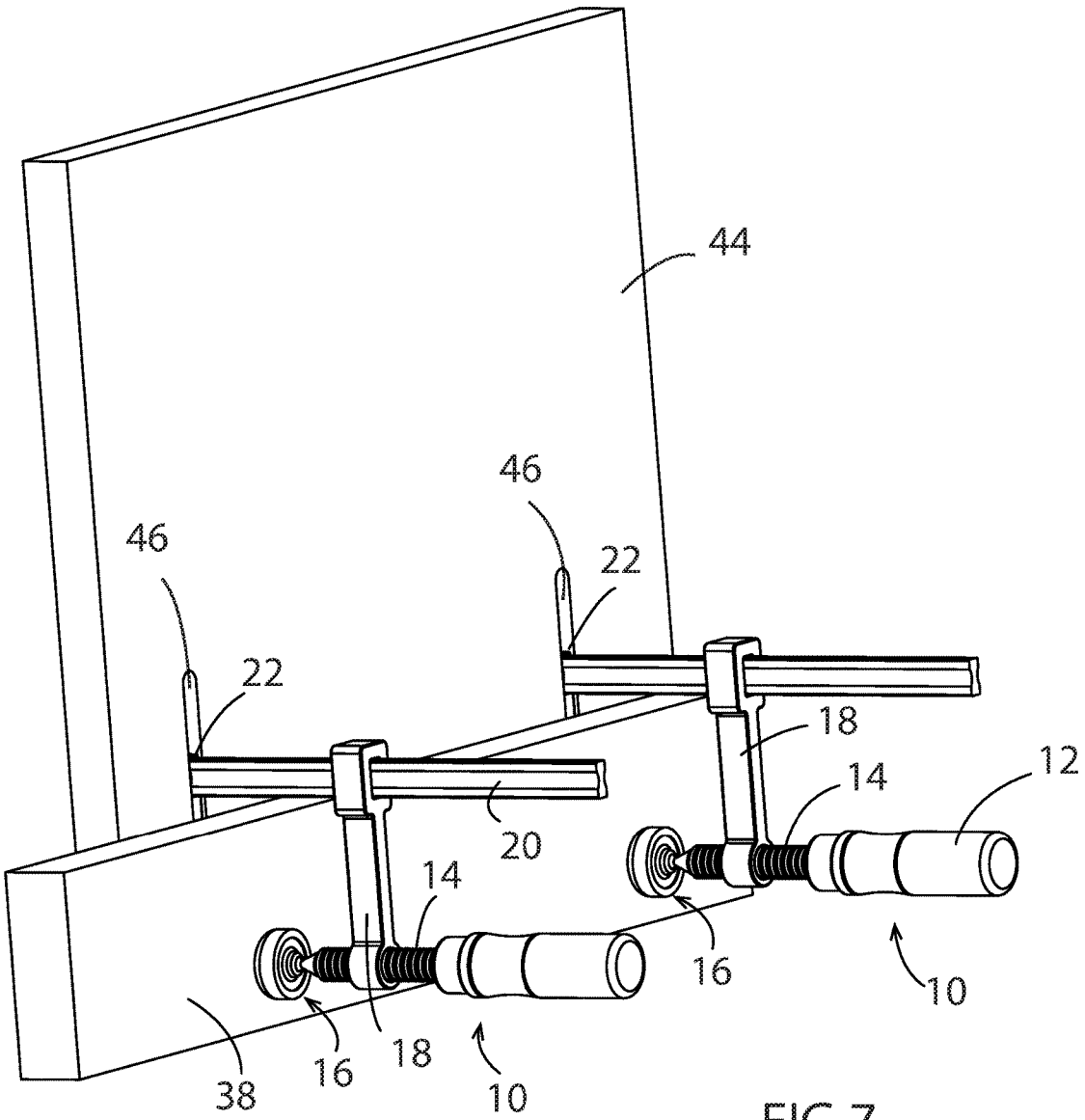
FIG. 7 is a perspective view of a larger auxiliary fence, relative to the auxiliary fence of FIG. 6, affixed to a machine fence of a woodworking cutting apparatus.

With respect to FIG. 5, the clamps 10 are shown in connection with a fence 38 and auxiliary fence 40 for a wood cutting apparatus. More specifically, the auxiliary fence 40 includes dovetail-shaped (or trapezoidal-shaped) channels 42 that extend the height of the auxiliary fence 40. In practice, the auxiliary fence 40 is positioned against the fence 38, and the clamping posts 22 of the clamps 10 are inserted into channels 42 and slid downward and adjacent to the fence 38. The engagement member 11, including the clamp head 16, is pushed toward the fence 38 so the head 16 abuts the fence 38 and the handle 12 is then rotated until the auxiliary fence 40 and fence 38 are firmly clamped together. In this manner, taller auxiliary or sacrificial fences may be used for larger work pieces to be cut. To that end, and with respect to FIG. 7, a taller auxiliary fence 44 with channels 46 may be clamped to fence 38 to serve as a support for re-sawing performed on a band saw, or on a table saw for supporting a raised panel. As further shown, the channels 46, and the channels shown in other embodiments, disclosed herein, do not have to extend an entire length, width or other dimension of the second component or auxiliary component 44. In the embodiment of FIG. 7, the second end 22B of the second post 22 may be inserted into the channel 44 and slid into position of clamping. Accordingly, second post 22 and first post 20 should be dimensioned to fit within the channel 44.

Figures 5A, 5B:
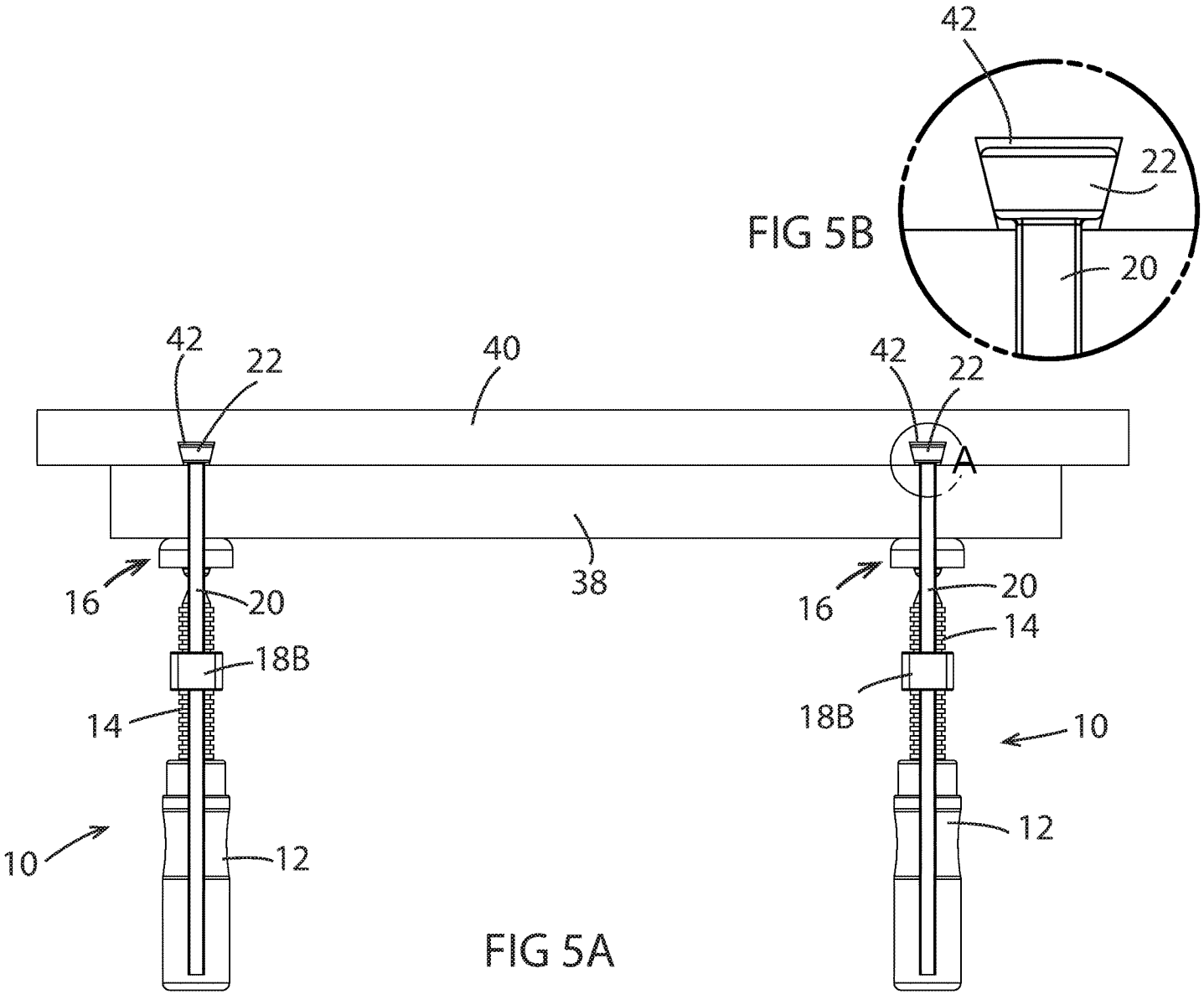
FIG. 5A is a top view of the auxiliary fence and machine fence of FIG. 5.
FIG. 5B is detail view illustrating the dovetail shaped clamping post in the dovetail channel of the auxiliary fence of FIG. 5A.

As shown in more detail in FIGS. 5A and 5B, the trapezoidal shape of the clamping post 22 corresponds to the dovetail shape of channels 42 so the clamping posts 22 remain within the channels 42 when the two components 38, 40 are tightened together. Moreover, forming the dovetail channels at such an angle does not create the above referenced thin strips of wood as compared to the T-shaped channels. The sides of the channels 42 provide sufficient support to the clamping posts 22, so the posts 22 remain in the channels during clamping and operation of the woodworking apparatus.

Figure 8:
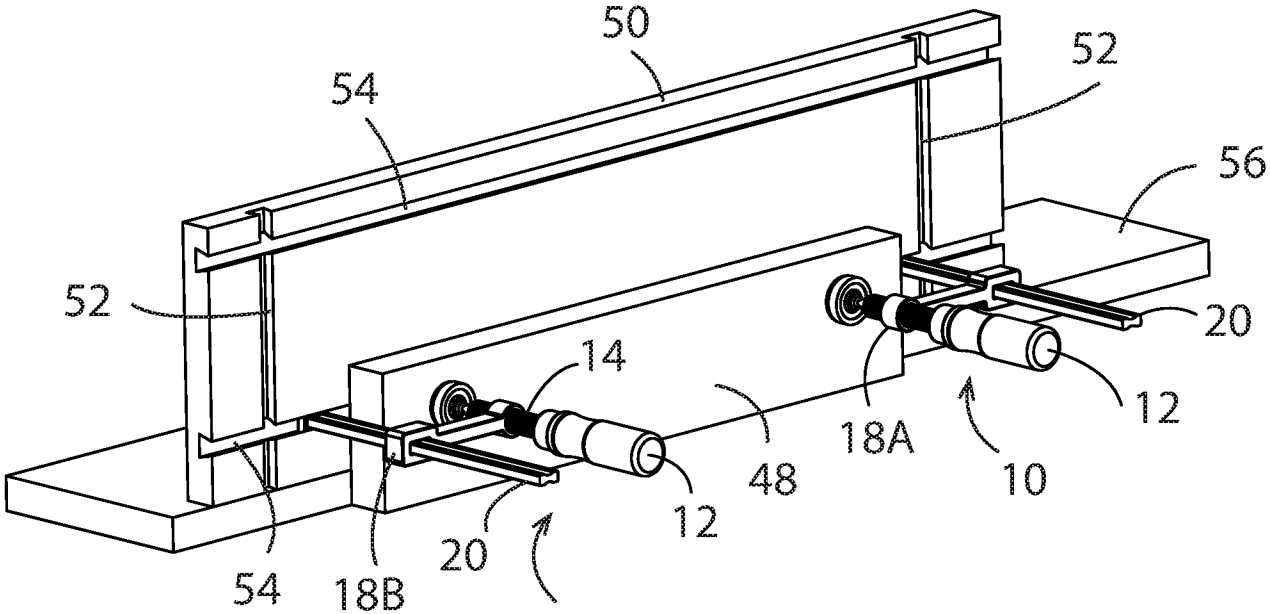
FIG. 8 is a perspective view of an auxiliary fence with horizontally and vertically disposed dovetail channels and an embodiment of the inventive clamp used to affix the auxiliary fence to the fence of a woodworking apparatus.
Figure 9:
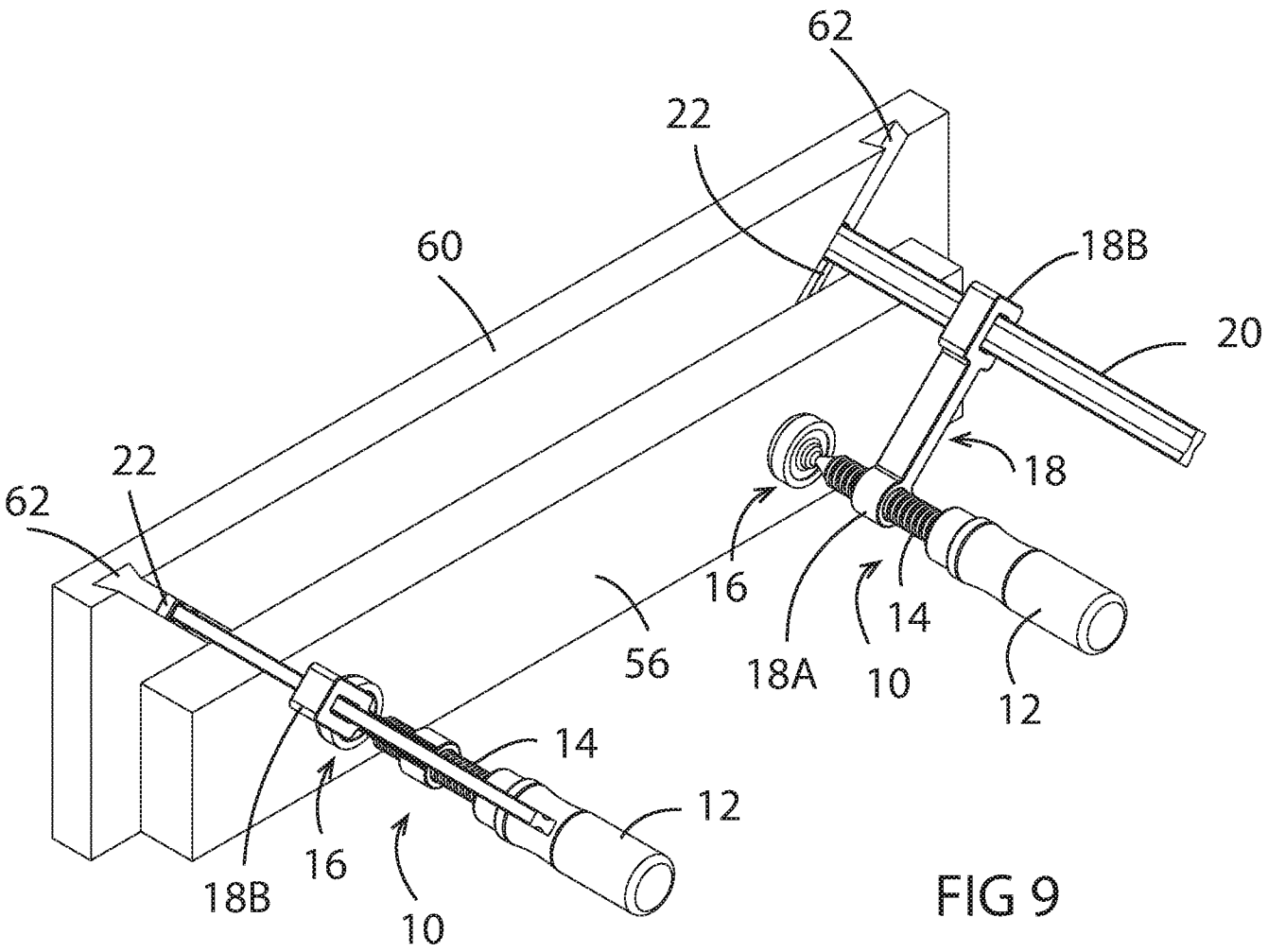
FIG. 9 is a perspective view of an auxiliary fence with diagonal dovetail channels and an embodiment of the inventive clamp used to affix the auxiliary to a fence of a woodworking cutting.

With respect to FIG. 8, the clamps 10 are shown in connection with clamping an auxiliary fence 50 on a work piece 56 both of which are longer than machine fence 48. Accordingly, the auxiliary fence 50 includes horizontally disposed dove-shaped channels 54 to access the fence 48 and auxiliary fence 50 from the sides for clamping. As shown, the auxiliary fence 50 may include vertically disposed channels 52 for use in connection with larger machine fences. As further shown in FIG. 9, the auxiliary fence 60 includes diagonally disposed channels 62, which cannot be formed in the above-described extruded metal fences. The clamps 10 are used to secure the auxiliary fence 60 to machine fence 58.

Figure 6:
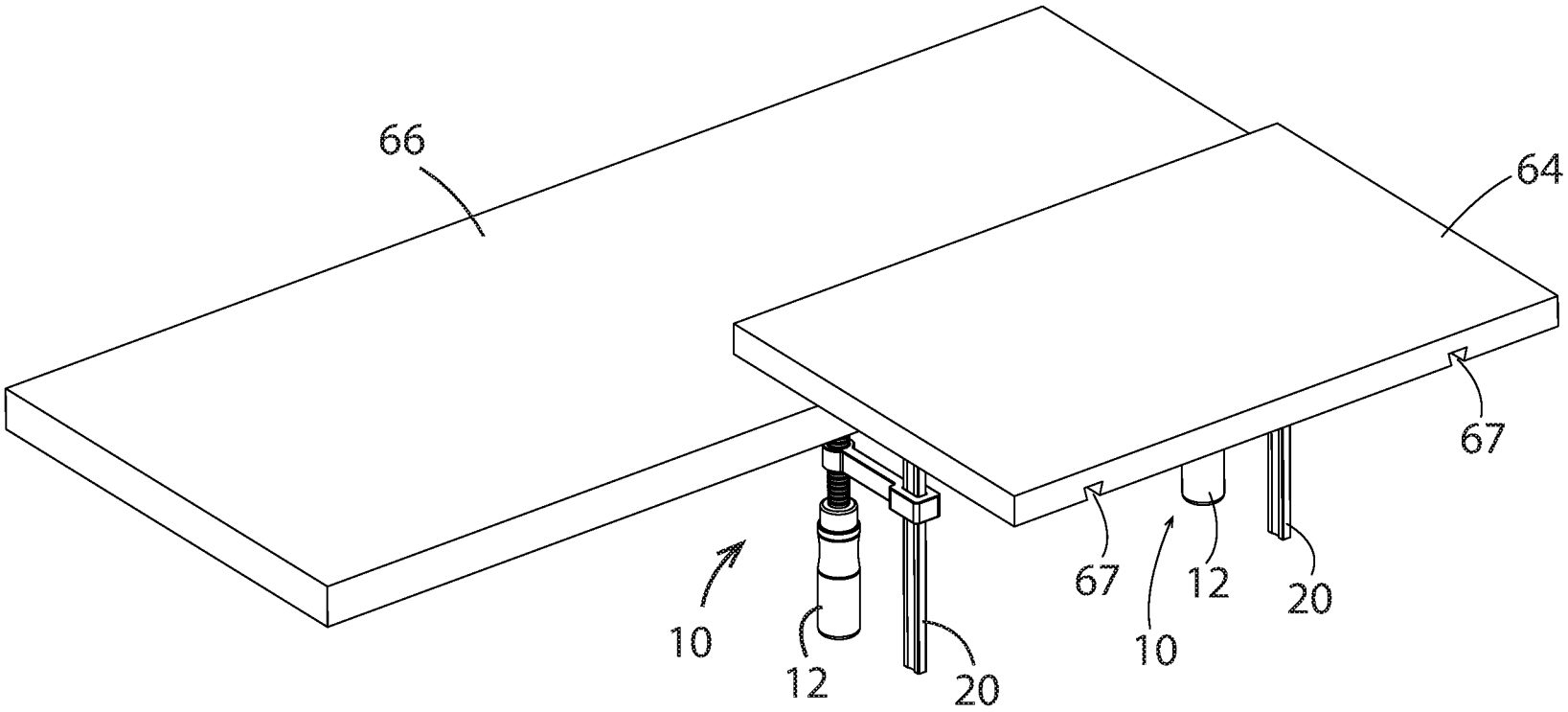
FIG. 6 is a perspective view of a wooden board affixed to a work bench using an embodiment of the inventive clamp.

In reference to FIG. 6, the clamps 10 are used to secure a wooden board 64 to a work bench 66 to provide an additional work surface. As shown, the board 64 includes dovetail shaped channels 67 in which the clamping posts 22 are inserted to clamp the board 64 to the bench 66.

Figure 10:
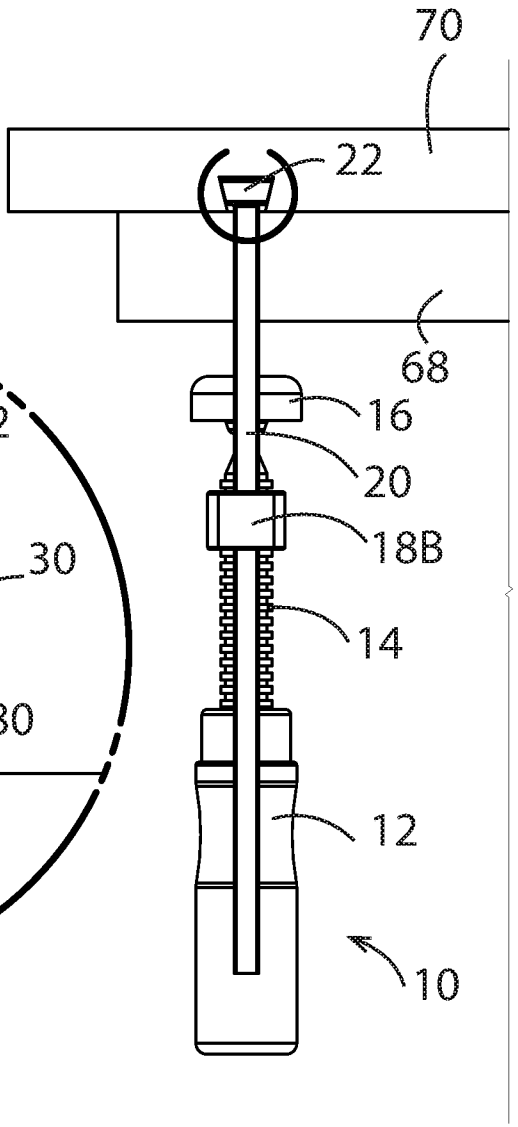
FIG. 10 is a top view of an embodiment of the inventive clamp with the clamping post inserted into a channel of an auxiliary fence, but the clamp is disengaged from a fence of a woodworking apparatus and a top view of the clamp engaged to secure an auxiliary fence to the fence of the woodworking apparatus.
Figure 10A:
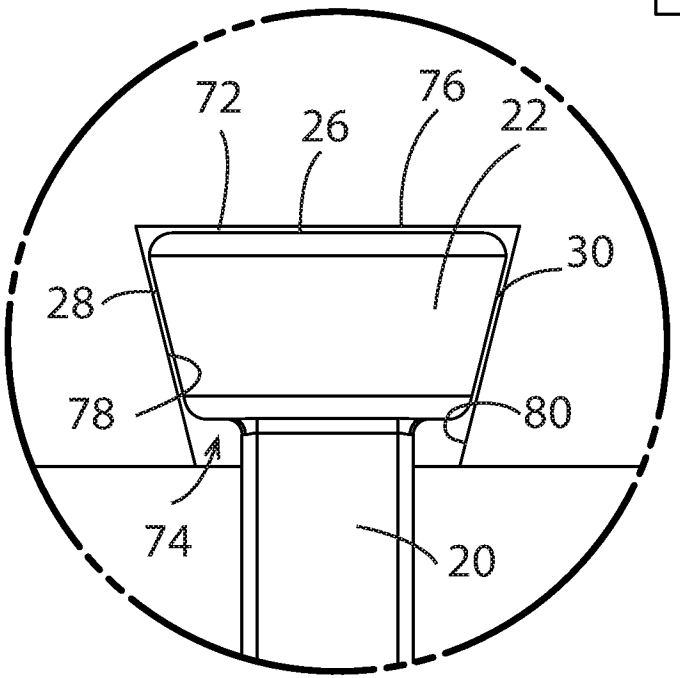
FIG. 10A is a detail view of the clamping post of FIG. 10 in the channel of the auxiliary fence.

The clamping device 10 of FIGS. 10 and 10A is shown disengaged relative to fence 68 and auxiliary fence 70. That is, the clamping post 22 has been inserted into channel 72; however, the engagement member 11 has not been moved toward the fence 68 so the clamp head 16 is not engaging the fence 68. As shown in FIG. 10A, the channel 72 includes an opening 74 spaced from a back surface 76, and inclined side surfaces 78 (first), 80 (second). With the clamping post 22 positioned toward the back surface 76 of the channel 72, the surfaces 26, 28, 30 of the clamping post 22 are spaced sufficiently from the surfaces 76, 78, 80 of the channel 72 to slide the clamping post 22 within the channel 72 to position clamping post 22 and clamp head 16 relative to the fences 68, 70 for clamping.

Figures 11, 11A:
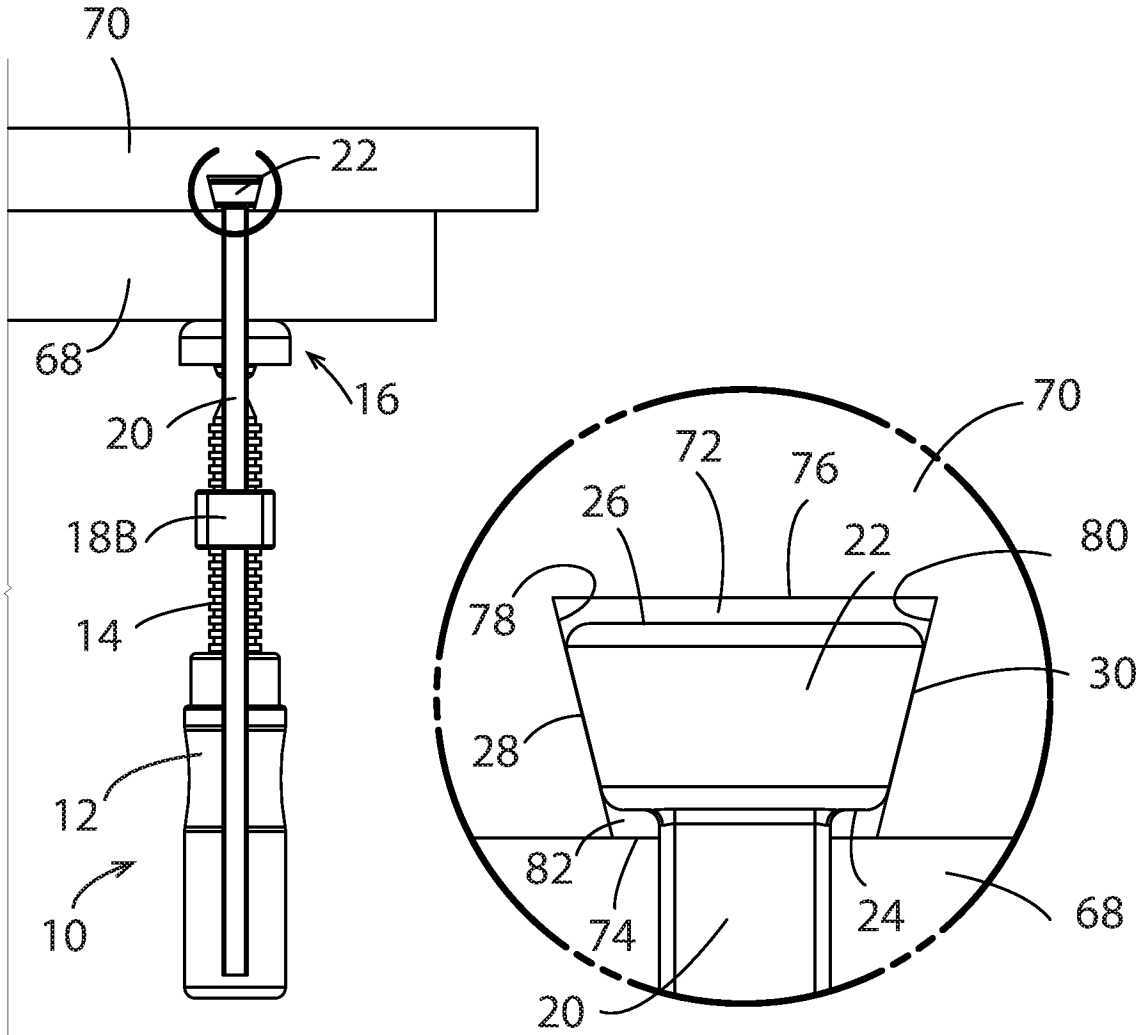
FIG. 11 is a top view of the clamp of FIG. 10 with the clamp adjusted to engage the fence of the working apparatus.
FIG. 11A is a detail view of the clamping post of FIG. 11 engaging surfaces of the channel of the auxiliary fence.

With respect to FIGS. 11 and 11A, the clamp head 16 and clamping post 22 are shown in engaged relative to fences 68, 70 respectively. As shown in FIG. 11A, when the clamp head 16 is tightened against fence 68, the clamping post 22 is pulled toward opening 74 of the channel 72, so that side surfaces 28, 30 of the clamping post 22 engage side surfaces 78, 80 of the channel 72. In as much as the clamping post 22 and channel 72 are similarly dimensioned, the clamping post 22 remains within the channel spaced from the fence 68 forming gap 82, so the edges of the opening 74 of the channel 72 are not exposed to stresses from the clamping post 22, and the fences 68, 70 are clamped flushed against one another. That is the side surfaces 28, 30 of the clamping post 22 engage the side surfaces 78, 80 of the channel 72.

Figure 12:
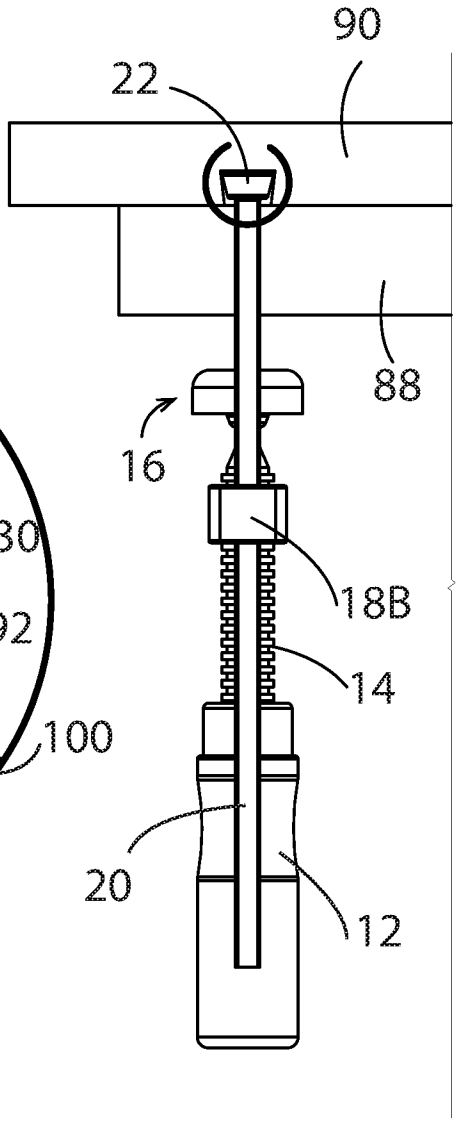
FIG. 12 is a top view of an embodiment of the inventive clamp with the clamping post inserted into a channel of an auxiliary fence, but the clamp is disengaged from a fence of a woodworking apparatus and a top view of the clamp engaged to secure an auxiliary fence to the fence of the woodworking apparatus.
Figure 12A:
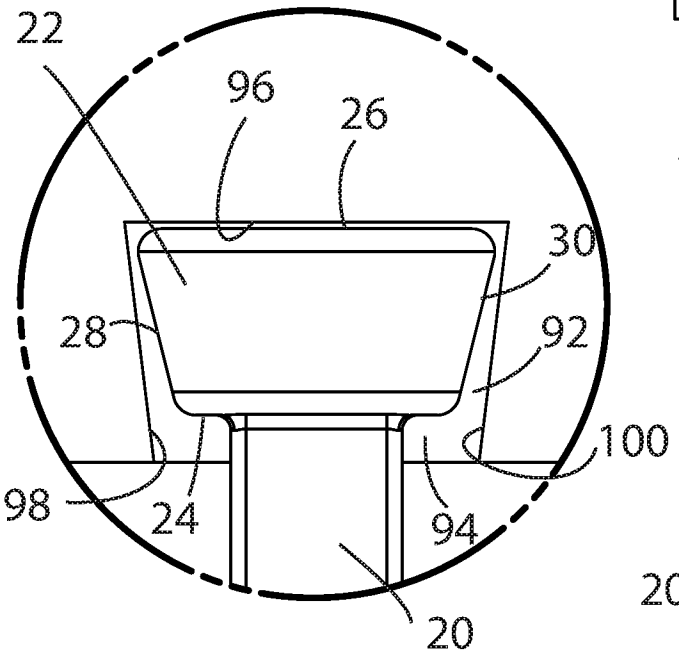
FIG. 12A is a detail view of the clamping post of FIG. 12 in the channel of the auxiliary fence, and the angled surfaces of the channel do not correspond to the shape of the clamping post.

The clamping device 10 of FIGS. 12 and 12A is shown disengaged relative to fence 88 and auxiliary fence 90. That is, the clamping post 22 has been inserted into channel 92; however, the engagement member 11 has not been moved toward the fence 88 so the clamp head 16 is not engaging the fence 88. As shown in FIG. 12A, the channel 92 includes an opening 94 spaced from a back surface 96, and inclined side surfaces 98 (first), 100 (second). However, in this example the channel 92 is not properly dimensioned relative to the clamping post 22. More specifically, the angles of the side surfaces 98, 100 relative to the back surface 96 are larger than the angle of the side surfaces 28, 30 relative to the back surface 26 of the clamping post 22.

Figures 13, 13A:
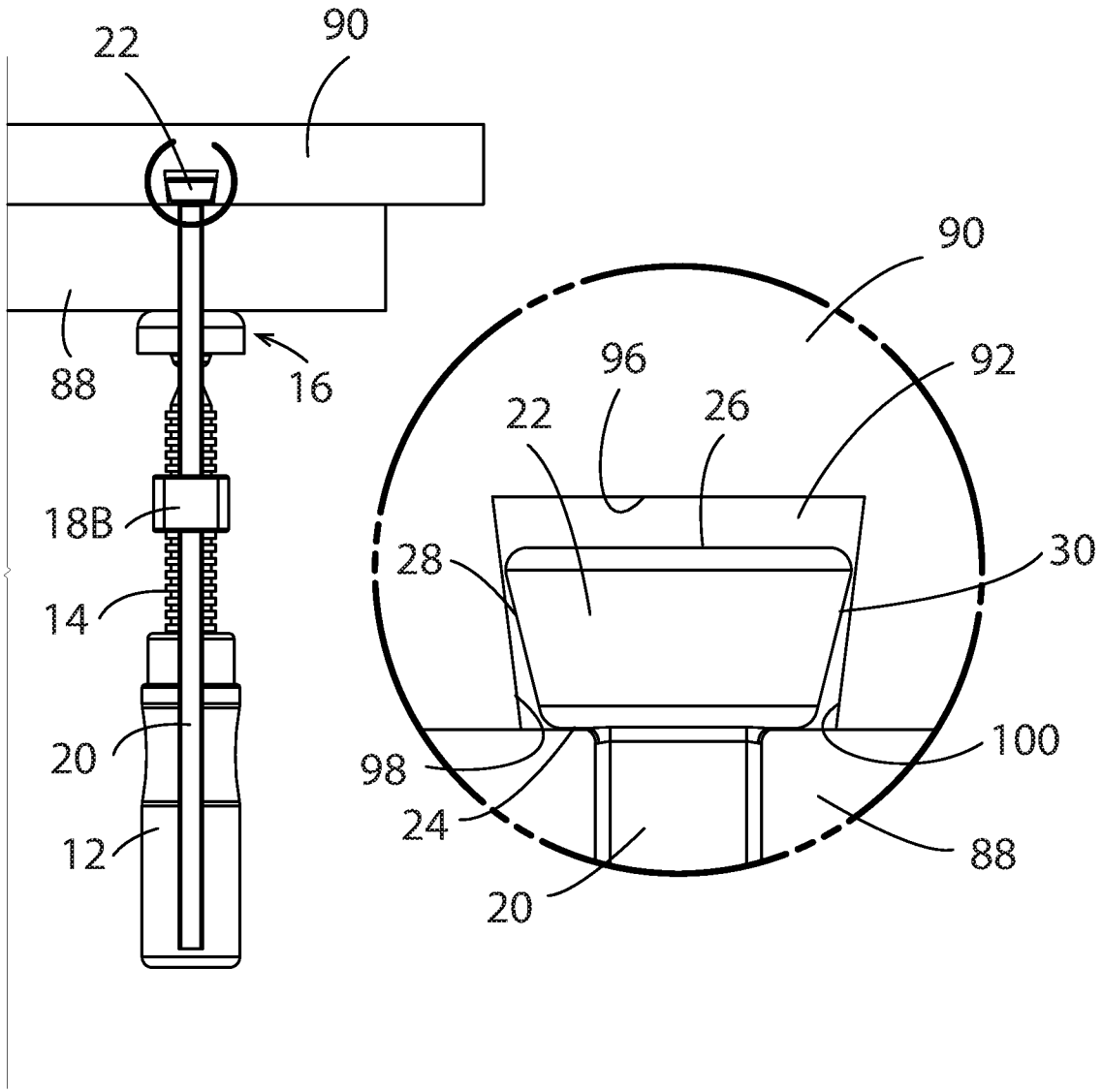
FIG. 13 is a top view of the clamp of FIG. 12 with the clamp adjusted to engage the fence of the working apparatus.
FIG. 13A is a detail view of the clamping post of FIG. 13 wherein the clamping post does not effectively engage the surfaces of the channel.

With respect to FIGS. 13 and 13A, the clamp head 16 and clamping post 22 are shown in engaged at least relative to fence 88. As shown in FIG. 13B, when the clamp head 16 and clamping post 22 are engaged against the fence 88, the side surfaces 28, 30 do not properly engage the side surfaces 98, 100 of the channel 92. In this manner, the auxiliary fence 90 cannot be properly secured to the fence 88. Accordingly, the channel 92 must have dimensions corresponding to the dimensions of the clamping post as shown in FIG. 11A to effectively clamp an auxiliary fence to a fence of a woodworking apparatus.

While the preferred embodiments of the present invention have been shown and described herein, it will be obvious that such embodiments are provided by way of example only. Numerous variations, changes and substitutions will occur to those of skill in the art without departing from the invention herein. Non-limiting examples include a component that is described above as being attached to one part of the apparatus may alternatively be attached to a different part of the apparatus in other embodiments. Parts described as being indirectly connected may be connected directly to each other, and vice versa. Component parts may be assembled from individual pieces or may be integrally formed as a single unit. Alternative types of connectors and alternative materials may be used. The apparatus may be used with other types of power tools. Accordingly, it is intended that the invention be limited only by the spirit and scope of the appended claims.

What is claimed is:

1. A multi-purpose utility clamp, comprising:

a component engagement member including a clamp head and a handle;

a guide arm operatively connected to the component engagement member at a first end of the guide arm;

a first post operatively connected to a second end of the guide arm to move linearly relative to the guide arm;

a second post at an end of the first post and disposed generally perpendicular to the first post and parallel to the guide arm and having a first end connected to the first post and a second end, distal the first end, and the second end is disposed opposite the clamping head; and, wherein the second post has a cross-section trapezoid shape along a length thereof between the first end and the second end, and the second post is configured to be inserted into a channel having a corresponding trapezoid shape and formed in an auxiliary component to be clamped to another component; and, wherein the cross-section trapezoid shape of the second post corresponds to a cross-section shape of the channel cut by a router bit having an outside diameter dimension and a taper dimension.

2. The utility clamp of claim 1, wherein the second post includes a first side surface and a second side surface, a front surface facing the clamp head and a back surface opposite and generally parallel to the front surface wherein the back surface is wider than the front surface, and the first and second side surfaces are each disposed at an angle of 13.5° to 14.5° relative to a reference line that is perpendicular to the back surface of the second post.

3. The utility clamp of claim 2, wherein each of the first and second side surfaces is disposed at an angle of about 14° relative to the back surface of the second post.

4. The utility clamp of claim 1, wherein the router bit has a ½ inch outside diameter and a 14° taper.

5. A multi-purpose utility clamp, comprising:

a component engagement member including a clamp head, a handle and a gear mechanism disposed between and connected to the clamp head and handle, and the handle is configured to move the gear mechanism;

a guide arm having a first end operatively connected to the gear mechanism for relative movement between the guide arm and the gear mechanism;

a first post operatively connected to a second end of the guide arm to move linearly relative to the guide arm;

a second post at an end of the first post and disposed generally perpendicular to the second post and parallel to the guide arm and having a first end connected to the first post and a second end, distal the first end, and the second end is disposed opposite the clamping head extending toward the clamping head;

wherein the second post includes a first side surface and a second side surface, a front surface facing the clamp head and a back surface opposite and generally parallel to the front surface wherein the back surface is wider than the front surface forming a cross-section trapezoid shape along a length of the second post; and, wherein the cross-section trapezoid shape of the second post corresponds to a cross-section shape of a channel cut by a router bit having an outside diameter dimension and a taper dimension.

6. The utility clamp of claim 5, wherein the router bit has a ½ inch outside diameter and a 14° taper.

7. A multi-purpose utility clamp in combination with an auxiliary component configured to be clamped to a woodworking apparatus, comprising:

a component engagement member including a clamp head and a handle;

a guide arm operatively connected to the component engagement member at a first end of the guide arm;

a first post operatively connected to a second end of the guide arm to move linearly relative to the guide arm;

a second post at an end of the first post and disposed generally perpendicular to the first post and parallel to the guide arm and having a first end connected to the first post and a second end, distal the first end, and the second end is disposed opposite the clamping head; and, wherein the second post has a cross-section trapezoid shape along a length thereof between the first end and the second end, and the second post is configured to be inserted into a channel having a corresponding trapezoidal shape and formed in an auxiliary component to be clamped to another component;

wherein the cross-section trapezoid shape corresponds to a cross-section shape of the channel cut by a router bit having an outside diameter dimension and a taper dimension; and, wherein the auxiliary component includes at least one channel formed therein, and the at least one channel has a cross-section trapezoid shape corresponding to the trapezoid shape of the second post.

8. The combination of the utility clamp and auxiliary component of claim 7, wherein the router bit has a ½ inch outside diameter and a 14° taper.

* * * * *